US009360163B2

(12) United States Patent
DeVarney

(10) Patent No.: US 9,360,163 B2
(45) Date of Patent: Jun. 7, 2016

(54) PASSIVE COMPRESSED GAS STORAGE CONTAINER TEMPERATURE STABILIZER

(71) Applicant: GLOBALFOUNDRIES INC., Grand Cayman (KY)

(72) Inventor: Craig N. DeVarney, Essex Junction, VT (US)

(73) Assignee: GLOBALFOUNDRIES INC., Grand Cayman (KY)

( * ) Notice: Subject to any disclaimer, the term of this patent is extended or adjusted under 35 U.S.C. 154(b) by 489 days.

(21) Appl. No.: 13/835,166

(22) Filed: Mar. 15, 2013

(65) Prior Publication Data

US 2014/0263357 A1 Sep. 18, 2014

(51) Int. Cl.
*F28F 7/00* (2006.01)
*F17C 13/08* (2006.01)

(52) U.S. Cl.
CPC ..... *F17C 13/084* (2013.01); *F17C 2201/0109* (2013.01); *F17C 2201/032* (2013.01); *F17C 2201/056* (2013.01); *F17C 2201/058* (2013.01); *F17C 2205/0103* (2013.01); *F17C 2205/018* (2013.01); *F17C 2205/0126* (2013.01); *F17C 2221/013* (2013.01); *F17C 2221/035* (2013.01); *F17C 2223/0153* (2013.01); *F17C 2223/033* (2013.01); *F17C 2225/0123* (2013.01); *F17C 2227/0311* (2013.01); *F17C 2227/0386* (2013.01); *F17C 2227/0397* (2013.01); *F17C 2270/0518* (2013.01)

(58) Field of Classification Search
CPC ..... F17C 13/084; F17C 13/10; F17C 13/126; F17C 2205/0103; F17C 2227/0386; F17C 2227/0397; F17C 2227/0313; F17C 2227/0376; F17C 2227/0381; F17C 2227/0383; F17C 2223/03; F17C 2223/00; F17C 2225/03; F17C 2225/00; F17C 2260/035; F17C 2260/03; F17C 7/04; F17C 7/02; F17C 7/00
See application file for complete search history.

(56) References Cited

U.S. PATENT DOCUMENTS

| | | | | |
|---|---|---|---|---|
| 3,672,446 | A * | 6/1972 | Tibbetts et al. | 165/183 |
| 4,745,966 | A * | 5/1988 | Avery | 165/104.33 |
| 5,531,242 | A * | 7/1996 | Paganessi | 137/255 |
| 5,673,562 | A | 10/1997 | Friedt et al. | |
| 6,363,728 | B1 * | 4/2002 | Udischas | F17C 7/04 62/48.1 |
| 6,474,077 | B1 * | 11/2002 | Botelho et al. | 62/50.2 |
| 2003/0046941 | A1 | 3/2003 | Pant et al. | |
| 2005/0121461 | A1 * | 6/2005 | Toth | 222/3 |
| 2005/0132720 | A1 * | 6/2005 | Rameau et al. | 62/50.1 |
| 2008/0282709 | A1 | 11/2008 | Sugawara et al. | |

* cited by examiner

*Primary Examiner* — Frantz Jules
*Assistant Examiner* — Jose O Class-Quinones
(74) *Attorney, Agent, or Firm* — Thompson Hine LLP; Anthony J. Canale

(57) ABSTRACT

A liquefied gas system and method can supply gas from a liquefied gas container more efficiently by using an external stabilizing device. The liquefied gas is located under its own vapor pressure in the lower portion of the container. As the vapor is withdrawn from the container at ambient pressure, the liquid evaporates at an equivalent rate to account for the decrease in pressure. The stabilizing device surrounding the liquefied gas container efficiently transfers the ambient external heat to the liquid thus allowing more liquefied gas to be vaporized.

12 Claims, 1 Drawing Sheet

PASSIVE COMPRESSED GAS STORAGE CONTAINER TEMPERATURE STABILIZER

FIELD OF THE INVENTION

This invention relates to a liquefied gas supply system which stabilizes a liquefied gas area of a storage container.

BACKGROUND

There is a growing need in semiconductor manufacturing to deliver specialty gases to the point of use at high flow rates. Conventional compressed gas storage containers (herein after also referred to as "container") such as, for example, vessels, cylinders and ton containers have liquefied gas under its own vapor pressure at ambient temperature. As the vapor is withdrawn from the container, the liquid evaporates at an equivalent rate to account for the decrease in pressure. This consumes energy from the remaining liquid in the container. In the absence of heat transfer to the container, the liquid temperature drops, leading to a corresponding drop in the vapor pressure. Further vapor withdrawal eventually subcools the liquid and the flow of vapor is reduced.

Along with liquid subcooling, rapid vapor withdrawal and uncontrolled heat transfer to the storage container also induces violent boiling at the container walls. This results in carryover of metastable liquid droplets into the vapor phase. In addition, the conventional sources of compressed gas storage deliver saturated vapor. A decrease in its temperature or a flow restriction in the process line leads to condensation. The presence of liquid droplets in the vapor stream is detrimental to most instruments and, therefore, needs to be minimized.

A solution is needed for three main reasons. First, chemical cost. In addition to the actual chemical cost savings there are savings that would be realized from getting the same amount of usable gas while handling fewer cylinders. Secondly, most liquified gasses are Green House gasses. Prime examples are Nitrous oxide, Carbon dioxide, hexafluoroethane and tetrafluoromethane. Said chemicals require additional weighing and documenting efforts in order to comply with existing Environmental Protection Agency Green House Gas requirements. There are possible future costs and impacts of EPA-mandatory reporting rule. Thirdly, the pressure instability can be an impact to process controls as regulators and mass flow controllers need to compensate.

In view of the foregoing, there is a need for a simplified method and system, which facilitates the withdrawal of gas from a compressed liquefied gas container by stabilizing the cylinder externally and passively to deliver high vapor flow rates from conventional sources, with minimal liquid carryover and without liquid subcooling.

SUMMARY

An aspect of this invention is directed to stabilizing the temperature of the lower portion of the liquefied gas storage container such as a vessel or a cylinder storage container by a removable device, which surrounds the bottom or boot or heel of the container.

Another aspect of the invention is directed a method for maintaining the pressure within the storage container for a longer period of time.

DETAILED DESCRIPTION OF THE DRAWINGS

Figure 1:
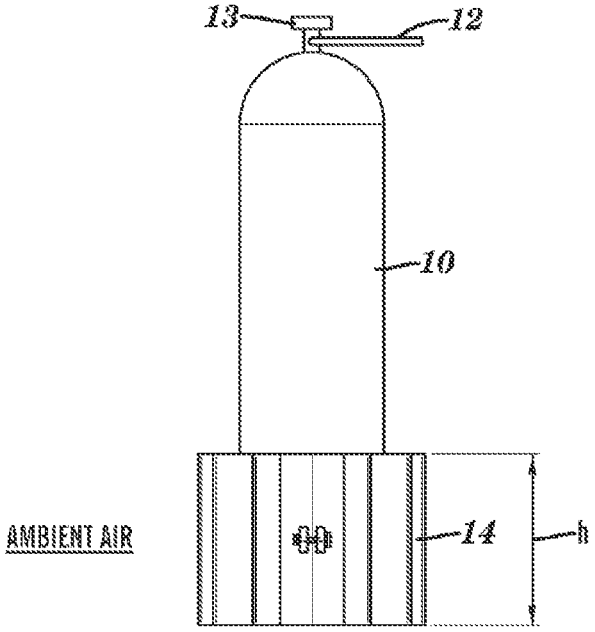

FIG. 1 provides a schematic representation of a typical liquefied compressed gas container in the form of a pressurized gas cylinder and the device, which is an embodiment of the invention.

Figure 2:
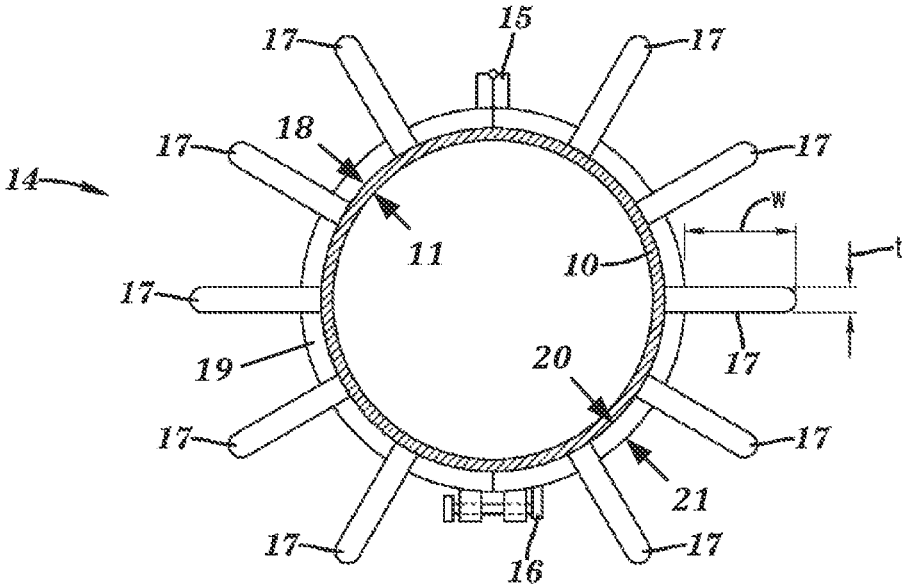

FIG. 2 provides a schematic representation of the top view of the device shown in FIG. 1.

DETAILED DESCRIPTION

As previously mentioned, the liquid-vapor balance exists within a compressed gas cylinder. As gas is removed from the container, the liquid evaporates to replace it, keeping the pressure in the cylinder constant. However, when the remaining liquid decreases, the area of outer wall in contact with liquid also decreases. The outer wall temperature it is controlled by both the ambient room temperature and the cooling effect of the liquid produced when gas is being drawn from the container. As the area of outer wall in contact with the liquid decreases the rate of heat exchange decreases. Thereby the liquid temperature can no longer be maintained and the liquid-vapor balance is not sustainable resulting in a pressure drop that is not stable. However, if a stabilizing device is wrapped around the liquid area of the base of the cylinder, providing a greater rate of heat exchange, the pressure stability is maintained.

Accordingly, an embodiment of the present invention includes a collar and fin unit constructed with a material that absorbs and transfers heat such as, for example, aluminum alloy, which is a material commonly used for heat sinks as well as other materials that are capable of transferring heat. Preferably the material should be mechanically soft enough to compress around the cylinder and be held tightly in place around the bottom of the container with a clamping type force to provide greater heat transfer from the ambient conditions to the cylinder wall and thereby extends the liquid and vapor balance equilibrium. The combined area of the fin unit is approximately equal to the external surface area of the container to which it is attached. Thus the design of the total number of fins, and the fin dimensions for thickness (t), height (h), and width (w) can vary to accommodate specific storage area constraints.

For example a design of a common compressed gas cylinder having an external diameter of 9 inches, an internal diameter of 8.5 inches and a height of 52 inches and a resultant surface area of 1389 square inches. The number of fins could be 20 fins, therefore each fin having an approximate area of 24 square inches. It is desirable to keep the footprint of the device small so a fin thickness of 1 inch, width of 2 inches and height of 12 inches may be chosen. The collar height should then be equal to the fin height of 12 inches. The collar inside diameter is equal to the external diameter of the gas cylinder, thus 8.5 inches. Therefore when the collar is wrapped around the exterior of the cylinder there is a gap provided at the latch. The latch provides the means for closing and tightening the gap, via screw, for firm fit.

Attention is directed to FIG. 1 illustrating a storage container as a compressed gas cylinder container (10) having an inner surface (11) and an outer surface (18), to which is attached to the device (14) at the base of the cylinder. The vaporized gas exits the cylinder (10) and flows through the conduit (12), which has a pressure reduction means (13) as well as a flow-control valve. The device (14) is attached to the cylinder by a collar (19) having an inner surface (20) and an outer surface (21) shown in FIG. 2. The inner diameter of the device (14) may be the same as the outer diameter of the cylinder.

The collar of the device is equipped with a hinge (15) on one side and a latch (16) on the opposing side. This allows the collar to be opened and then fitted around the bottom or heel of the compressed gas cylinder (10). The latch provides the means for closing the collar and tightening, via screw, for a firm fit and heat transfer. A plurality of cooling fins (17) is mounted radially around the collar. The total external surface area of the collar and fins approximates the total surface area of the internal cylinder wall. The device provides passive heat from the ambient room air like a heat sink to the contents in the lower portion of the cylinder. This maintains the liquid-vapor balance and maximizes the amount of the liquid gas that can be obtained from the cylinder. Furthermore, the device is readily attachable and passive.

The collar (19) of the device (14) and fins (17) are constructed preferably of heat-conductive material such as steel, copper, or an aluminum alloys such as 1050A, 6061 or 6063. The total external surface area of the collar and fins is designed to approximate the total surface area of the internal cylinder wall.

The embodiment of the invention above uses a compressed gas cylinder as the gas storage container as an example, however it should be understood that the device may be adapted to be used with other types of storage containers. It is given that the chemical in the cylinder is a liquefied gas described as gases, which can remain liquid at normal temperatures when inside cylinders under pressure. The liquefied gas exists inside the cylinder in a liquid-vapor balance or equilibrium. Initially the cylinder is almost full of liquid, and gas fills the space above the lower portion of liquid. As gas is removed from the cylinder, enough liquid evaporates to replace it, keeping the pressure in the cylinder constant. Anhydrous ammonia, chlorine, propane, nitrous oxide and carbon dioxide are examples of liquified gases. However, as the level of the liquefied chemical drops, the amount of cylinder internal wall surface area in direct contact with the remaining liquid decreases also. The cylinder internal wall surface is the source of energy to support the evaporation. Eventually, there will not be enough of the cylinder wall in contact to transfer the ambient room temperature to the remaining liquid, and the temperature of the liquid will decrease. At this point the liquid-vapor balance is no longer sustainable resulting in pressure drops. The pressure drops and the instability affects dependent process controls and renders the chemical that remains in the cylinder useless.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. An apparatus attached to an exterior surface of a compressed gas storage container, the compressed gas storage container having an interior surface entrapping an upper portion of vaporized gas and a lower portion of liquefied gas, the apparatus comprising:

a collar configured to externally encircle a lower portion of the compressed gas storage container to provide thermal contact between a lower portion of the compressed gas storage container and ambient surroundings to stabilize a pressure inside the compressed gas storage container; and a plurality of fins that are in thermal contact with the collar and extend radially away from the exterior surface of the compressed gas storage container, wherein the collar is configured to be held in place by a firm fit between the collar and the compressed gas storage container to passively provide ambient heat energy from outside the of the compressed gas storage container to the lower portion of liquefied gas, and a surface area of the collar and fins exposed to the ambient surroundings is equivalent to a total surface area of the interior surface of the compressed gas storage container.

2. The apparatus of claim 1, wherein the apparatus further comprises a hinge and a latch configured to provide the firm fit.

3. The apparatus of claim 1, wherein the compressed gas storage container is a compressed gas cylinder.

4. The apparatus of claim 1, wherein the compressed gas storage container is a vessel.

5. The apparatus of claim 1, wherein the collar is made of a material that transmits ambient heat from outside of the compressed gas storage container to the lower portion of the compressed gas storage container.

6. The apparatus of claim 1, wherein the collar comprises steel, copper, or an aluminum alloy.

7. The apparatus of claim 1, wherein a compressed gas comprising nitrous oxide, carbon dioxide, hexafluoroethane or tetrafluoromethane is entrapped in the compressed gas storage container.

8. A method for maintaining pressure in a compressed gas storage container having an exterior surface and a base, the method comprising:

providing the compressed gas storage container having an interior surface that entraps an upper portion of vaporized compressed gas and a lower portion of liquefied compressed gas; and attaching a collar to the exterior surface of the compressed gas storage container so that the collar encircles the lower portion of liquefied compressed gas thereby stabilizing the lower portion of liquefied compressed gas, wherein the collar includes a plurality of fins that are in thermal contact with the collar and extend radially away from the exterior surface of the compressed gas storage container, the collar is configured to be held in place by a firm fit between the collar and the compressed gas storage container to passively provide ambient heat energy from outside of the compressed gas storage container to the lower portion of liquefied compressed gas, and a surface area of the collar and fins exposed to the ambient surroundings is equivalent to a total surface area of the interior surface of the compressed gas storage container.

9. The method of claim 8, further comprising maximizing an amount of liquefied compressed gas removed from the compressed gas storage container.

10. The method of claim 8 wherein the collar includes a latch, and a first portion and a second portion connected by a hinge, and attaching the collar comprises:

pivoting the first portion relative to the second portion about the hinge; and securing the latch to provide the firm fit.

11. The method of claim 8, further comprising:

filling the compressed gas storage container with a compressed gas comprising nitrous oxide, carbon dioxide, hexafluoroethane or tetrafluoromethane.

12. The method of claim 8, further comprising:

releasing a compressed gas comprising nitrous oxide, carbon dioxide, hexafluoroethane or tetrafluoromethane from the compressed gas storage container.

* * * * *